United States Patent [19]

Enoki et al.

[11] Patent Number: 4,885,223

[45] Date of Patent: Dec. 5, 1989

[54] METHOD AND APPARATUS FOR DEVELOPING ELECTROSTATIC LATENT IMAGE

[75] Inventors: Shigekazu Enoki, Kawasaki; Noboru Sawayama, Tokyo; Shunji Katoh, Sagamihara; Noriyuki Kimura, Kawasaki, all of Japan

[73] Assignee: Ricoh Company, Ltd., Tokyo, Japan

[21] Appl. No.: 16,739

[22] Filed: Feb. 20, 1987

[30] Foreign Application Priority Data

| | | | |
|---|---|---|---|
| Feb. 20, 1986 | [JP] | Japan | 61-035544 |
| Apr. 18, 1986 | [JP] | Japan | 61-090686 |
| May 6, 1986 | [JP] | Japan | 61-103473 |
| May 14, 1986 | [JP] | Japan | 61-110249 |
| May 14, 1986 | [JP] | Japan | 61-110250 |
| Jul. 18, 1986 | [JP] | Japan | 61-169318 |
| Aug. 13, 1986 | [JP] | Japan | 61-189932 |
| Aug. 13, 1986 | [JP] | Japan | 61-189933 |
| Oct. 20, 1986 | [JP] | Japan | 61-249298 |

[51] Int. Cl.[4] ..... G03G 15/08; G03G 15/09; B05C 11/10

[52] U.S. Cl. ..... 430/122; 118/652; 118/656; 118/657; 118/658; 118/663; 118/712; 355/250; 355/251; 355/253; 430/123

[58] Field of Search ..... 118/658, 657, 652, 656, 118/663, 712; 430/122, 123; 355/3 DD, 250, 251, 253

[56] References Cited

U.S. PATENT DOCUMENTS

| | | | |
|---|---|---|---|
| 4,288,518 | 9/1981 | Miyamoto | 430/122 |
| 4,347,299 | 8/1982 | Ozawa et al. | 430/122 |
| 4,538,897 | 9/1985 | Osaka et al. | 355/3 DD |
| 4,566,776 | 1/1986 | Kondoh | 355/3 DD |
| 4,676,192 | 6/1987 | Yuge et al. | 118/658 |

FOREIGN PATENT DOCUMENTS

| | | |
|---|---|---|
| 60-126658 | 7/1985 | Japan . |
| 2064379 | 6/1981 | United Kingdom . |
| 2098095 | 11/1982 | United Kingdom . |
| 2163371 | 2/1986 | United Kingdom . |

*Primary Examiner*—Evan Lawrence

*Attorney, Agent, or Firm*—Oblon, Spivak, McClelland, Maier & Neustadt

[57] ABSTRACT

A method for developing an electrostatic latent image includes the steps of preliminarily charging a toner, supplying the preliminarily charged toner to a resilient developing brush held in resilient contact with a latent image carrier while electrically charging the toner in a toner supplying region, transferring the toner on the resilient developing brush to an image developing region, developing the electrostatic latent image formed on the image carrier with the toner by bringing the resilient developing brush into contact with the latent image carrier and the image developing region, transferring the resilient developing brush from the image developing region to a toner recovering region separate from the toner supplying region after the image has been developed, recovering residual toner from the resilient developing brush in the toner recovering region in order to remove toner density irregularities from the resilient developing brush, and thereafter transferring the resilient developing brush to the toner supplying region for successive image development. Also provided is an apparatus for carrying out the above steps.

21 Claims, 14 Drawing Sheets

METHOD AND APPARATUS FOR DEVELOPING ELECTROSTATIC LATENT IMAGE

BACKGROUND OF THE INVENTION

1. Field of the Invention

The present invention relates to a method of and an apparatus for developing an electrostatic latent image with a dry-type two-component developer while stabilizing the density of the developed image at all times.

2. Description of the Prior Art

FIG. 27 of the accompanying drawings illustrates an image developing apparatus which is generally employed for carrying out a method of developing an electrostatic latent image using a dry-type two-component developer. The image developing device includes a large toner tank 1 housing various agitating mechanisms such as an agitating roller 2, a feed screw 3, and an agitating separator 4. Toner which has been supplied from a toner hopper 5 is mixed with a carrier and agitated by these agitating mechanisms, and then delivered onto a developing roller 6 serving as a developer carrier, on which the toner is deposited as a magnetic brush layer. The thickness of the deposited developer or magnetic brush layer is limited by a doctor blade 7.

The developing roller 6 includes a sleeve 8 with a pluraltity of magnets 9 disposed therein. At least one of the sleeve 8 and the magnet assembly is rotated in one direction to move the magnetic brush on the circumferential surface of the sleeve 8 in a certain direction. The magnetic brush is brought into contact with a photosensitive body 10 to develop an electrostatic latent image thereon into a visible toner image. After the image has been developed, the magnetic brush is scraped off the developing roller 6 into the toner tank 1. The toner that has fallen into the toner tank 1 is agitated and mixed again by the agitating mechanisms.

The two-component developer or toner is required to be well agitated and mixed for uniform toner density or good toner charging. The conventional method and apparatus for developing electrostatic latent images using the two component developer are advantageous in that developed images are of good quality. However, the various agitating mechanisms are necessary for sufficiently agitating the developer, and a large space is required for defining an agitating passage in which the developer is agitated by those agitating mechanisms. Another problem is that the carrier of the developer is fatigued by the agitation of the developer, resulting in a reduction of carrier durability.

In order to eliminate the drawbacks of the image developing apparatus using the two-component developer, there have been proposed various image developing apparatus in which the developer is not mixed and agitated. One such image developing apparatus is of the self-balanced type as disclosed in U.S. Pat. No. 4,615,606 and includes a charging roller for depositing toner thereon, the charging roller contacting a magnetic brush to supply toner. In another image developing apparatus, a magnetic brush is employed to supply toner to a developing roller for forming a thin toner layer on the developing roller. The former image developing apparatus, however, presents problems in that the toner on the developing roller has irregular densities because uniform balancing forces cannot be obtained due to irregular charged amounts among toner particles and irregular toner particle diameters. With the latter apparatus, the toner or developer is still required to be well mixed and agitated.

SUMMARY OF THE INVENTION

It is an object of the present invention to provide a method of and an apparatus for developing an electrostatic latent image through a hybrid arrangement in which a two-component developer that is not required to be agitated is employed thereby to dispense with various agitating mechanisms and an agitating space, the apparatus size is largely reduced, the two-component developer can be handled in the same manner as a one-component developer, the carrier of the two-component developer is prevented from being quickly fatigued, and image stability and flexibility achieved by the two-component developer are retained.

Another object of the present invention is to provide a method of and an apparatus for developing an electrostatic latent image through a hybrid arrangement in which toner can be supplied in a large quantity, without being agitated, even when toner consumption is high such as for color copying or printing, so that stable images can be produced with low density irregularities and image deterioration.

Still another object of the present invention is to provide a method of and an apparatus for developing an electrostatic latent image through a hybrid arrangement in which toner can be supplied at an appropriate constant rate by a developing brush means with a simple structure.

Yet still another object of the present invention is to provide a method of and an apparatus for developing an electrostatic latent image through a hybrid arrangement in which toner supplied to a developing brush means can well be formed as a thin layer and triboelectrically charged, and toner remaining on a toner supplying means can be scraped off for initialization of the toner supplying means.

A further object of the present invention is to provide a method of and an apparatus for developing an electrostatic latent image through a hybrid arrangement in which a carrier is prevented from being mixed with reused toner to keep a toner supplying means from being damaged by the carrier.

A still further object of the present invention is to provide a method of and an apparatus for developing an electrostatic latent image through a hybrid arrangement in which toner can be supplied to and recovered from a developing brush means with high efficiency.

A yet still further object of the present invention is to provide a method of and an apparatus for developing an electrostatic latent image through a hybrid arrangement in which toner can well be exchanged between a developing region, a toner supplying region, and a toner recovering region.

Another object of the present invention is to provide a method of and an apparatus for developing an electrostatic latent image through a hybrid arrangement in which toner can well be supplied to a developing brush means.

Still another object of the present invention is to provide a method of and an apparatus for developing an electrostatic latent image through a hybrid arrangement in which a bias voltage for supplying toner and a bias voltage for recovering toner are well balanced to equalize toner supply and recovery.

According to the present invention, there is provided a method of developing an electrostatic latent image, comprising the steps of: preliminarily charging the toner, supplying the toner to resilient developing brush means held in resilient contact with a latent image carrier while electrically charging the toner in a toner supplying region; transferring the resilient developing brush means with the toner to an image developing region; developing an electrostatic latent image formed on the image carrier with the toner by bringing the resilient developing brush means into contact with the latent image carrier in the image developing region; transferring the resilient developing brush means from the image developing region to a toner recovering region after the image has been developed; recovering residual toner from the resilient developing brush means in the toner recovering region in order to remove toner density irregularities from the resilient developing brush means; and thereafter, transferring the resilient developing brush means again to the toner supplying region for successive image development.

According to the present invention, there is also provided an apparatus for developing an electrostatic latent image, comprising: resilient developing brush means for holding preliminarily charged toner and resiliently contacting a latent image carrier in an image developing region to supply the toner to an electrostatic latent image formed on the latent image carrier; toner supply means for supplying charged toner to the resilient developing brush means in a toner supplying region; and toner recovery means for recovering residual toner from the resilient developing means in a toner recovering region after the image has been developed by the toner.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
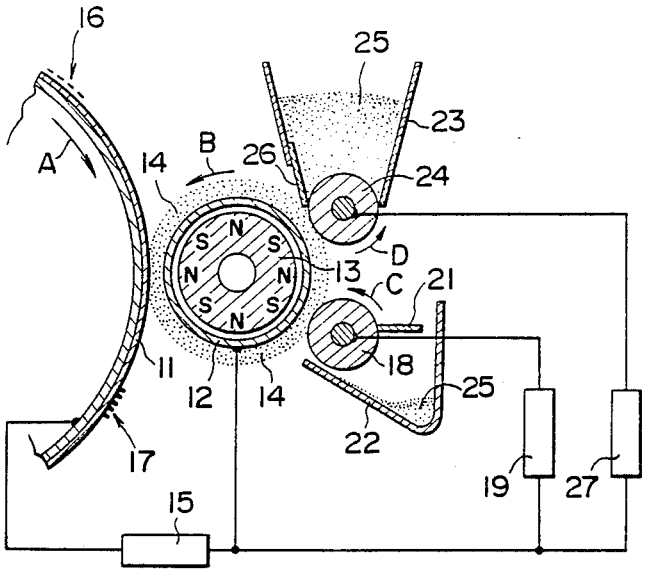
FIG. 1 is a vertical cross-sectional view of an image developing apparatus according to an embodiment of the present invention.

Like or corresponding parts are denoted by like or corresponding reference numerals throughout several views.

As shown in FIG. 1, a photosensitive drum or latent image carrier 11 is rotatable about its own axis in the direction of the arrow A by a driving mechanism (not shown). A cylindrical sleeve 12 made of a nonmagnetic material such as aluminum is disposed near the photosensitive drum 11. The cylindrical sleeve 12 houses therein a magnet 13 with a plurality of alternately different magnetic poles, the magnet 13 being radially inwardly spaced from the inner circumferential surface of the sleeve 12. The magnet 13 produces magnetic forces for producing a magnetic brush 14, which is moved in the direction of the arrow B when at least one of the cylindrical sleeve 12 and the magnet 13 is rotated. The magnetic brush 14 is composed of a carrier which may be the carrier used in a general two-component developer. The carrier should preferably be electrically insulative enough not to produce leakage of an electrostatic latent image and also be chargeable to a prescribed polarity to retain toner.

A bias voltage of the same polarity as that of a latent image for developing the latent image is applied by a power supply circuit 15 to the cylindrical sleeve 12. The polarity of the bias voltage applied to the sleeve 12 remains the same irrespective of whether negative-to-positive (normal) or positive-to-positive (reversal) image development is carried out. The magnetic brush 14 on the cylindrical sleeve 12 is moved in contact with the photosensitive drum 11 to apply toner to an electrostatic latent image 16 formed on the drum 11 for thereby developing the latent image 16 into a visible image 17.

In the embodiment of FIG. 1, the cylindrical sleeve 12 has an outside diameter of 25 mm, and the magnet 13 is capable of producing magnetic forces on the outer circumferential surface of the cylindrical sleeve 12 at a magnetic flux density of about 800 gausses. The magnetic brush 14 generated has a height ranging from 0.3 to 5 mm, and preferably from 0.7 to 2 mm.

The image developing bias voltage is applied to prevent unwanted toner deposits on the background of a copy and also to adjust the density of an image on the copy. Where the potential of the latent image is −800 V and normal image development is desired, it is preferable that a developing bias voltage in the range of from 0 to −500 V be applied. For reversal image development, negatively chargeable toner should be employed, and the developing bias voltage should range from −200 to −800 V. The final developing bias voltage is determined in view of the density of a document to be copied or as the user wishes.

A toner recovery roller 18 is disposed laterally and downwardly of the cylindrical sleeve 12 for recovering residual toner from the magnetic brush 14 after the image on the photosensitive drum 11 has been developed. The toner recovery roller 18 is positioned in contact with the magnetic brush 14. A bias voltage for recovering toner is applied by a power supply circuit 19 to the toner recovery roller 18, the toner recovering bias voltage being of the polarity opposite to that of charged toner. The toner recovering bias voltage serves to recover toner remaining on the magnetic brush 14, and is of the same level as the developing potential, i.e., of such a level that it would be able to develop an entire latent image on the toner recovery roller 18 if the roller 18 were a latent image carrier. If the latent image potential is −800 V and the image developing bias voltage is −200 V, then the toner recovering bias voltage may be about −600 V.

It is not necessary to recover the entire toner contained in the magnetic brush 14, but it suffices to selectively recover toner in the vicinity of the surface of the magnetic brush 14. The toner recovery is effected at least to remove toner density irregularities on the magnetic brush 14 which have been caused by the image development. For example, different toner densities on the magnetic brush 1 resulting from different toner consumption rates in black, halftone, and background areas are equalized by the toner recovery roller 18.

Generally, toner of a two-component developer is applied in an amount ranging from 0.8 to 1.0 mg per unit area. Toner is supplied to the latent image 16 while the photosensitive drum 11 and the magnetic brush 14 are relatively rotating at a speed ratio of about 1:3. Therefore, the magnetic brush 14 is only capable of supplying toner in the range of 0.27 to 0.33 mg per unit area. By recovering remaining toner at a rate exceeding the toner supplying capability of the magnetic brush 14, the toner densities on the magnetic brush 14 can be uniformized thereby to cancel out adverse effects given by the image development.

More specifically, a general two-component developer has a bulk specific gravity of 2 and a toner density of 3%. With such a two-component developer used, the weight of a magnetic brush having a height of 1 mm is 0.2 g per unit area ($cm^2$). Since the weight of toner contained in that unit magnetic brush volume is 6 mg, the toner which actually contributes to image development is only 5% of the magnetic brush. Stated otherwise, it only suffices to recover toner corresponding to that 5%. Differences in toner consumption by the magnetic brush can effectively be eliminated inasmuch as toner at a density of about 0.3 $mg/cm^2$ is localized in the vicinity of the surface of the magnetic brush by a toner supply roller (described below).

The toner recovery roller 18 is driven to rotate about its own axis in the direction of the arrow C for preventing recovered toner from being applied again to the magnetic brush 14. The toner recovery roller 18 is combined with a scraper blade 21 and a toner receiver tray 22. The recovered toner is scraped off the toner recovery roller 18 by the scraper blade 21 into the toner receiver tray 22, and then delivered back into a toner hopper 23.

A toner supply roller 24 is disposed laterally and upwardly of the cylindrical sleeve 12 in contact with the magnetic brush 14. The toner supply roller 24 has an upper half located in the toner hopper 23 and is driven to rotate about its own axis in the direction of the arrow D by means of a driver mechanism (not shown). As the toner supply roller 24 is rotated, toner 25 stored in the toner hopper 23 is supplied to the magnetic brush 14 via the toner supply roller 24. The toner supply roller 24 is also capable of limiting the heights of brush fibers of the magnetic brush 14 to a uniform level for eliminating image density irregularities.

A toner layer limiting blade 26 is attached to the toner hopper 23 in the lower opening in which the toner supply roller 24 is disposed. The toner layer limiting blade 26 has a tip edge pressed against the toner supply roller 24 for applying a uniform thin layer of toner 25 to the toner supply roller 24 while at the same time triboelectrically charging the toner 25. This preliminary charge allows a large amount of toner to be supplied safely and effectively.

Another blade or roller (not shown) may also be disposed closely to the sleeve 12 between the toner supply roller 24 and the photosensitive drum 11 for uniformizing the heights of the brush fibers of the magnetic brush 14.

To the toner supply roller 24, there is applied a toner supplying bias voltage by a power supply circuit 27 for efficiently transferring the toner 25 to the magnetic brush 14. The toner supplying bias voltage is of the same polarity as that of the charged toner and ranges from about 0 to 600 V. In order that the toner can reliably be retained on the toner supply roller 24, a toner supply bias voltage of the polarity opposite to that of the charged toner is applied. In such a case, it is better to make the toner supply bias voltage lower than the image developing bias voltage. Assuming that the voltages to be impressed on the sleeve 12, the recovery roller 18, and the supply roller 24 are of the same polarity and are indicated respectively by $V_B$, $V_R$, $V_D$, it is preferable that the following relationship:

$$|V_B| \geqq V_D|$$

be met for well-balanced toner supply to and recovery from the sleeve 12. Moreover, the following relationship should preferably be met:

$$|V_B| - |V_D| \geqq |V_R| - |V_B|$$

for more uniform toner density on the sleeve 12.

The toner recovery roller 18 and the toner supply roller 24 may be made of metal, electrically conductive rubber, or the like insofar as an electric bias can be applied between these rollers and the cylindrical sleeve 12. The rollers 18, 24 are disposed in contact with the magnetic brush 14 in a position ranging from 50% to 100% of the height of the magnetic brush 14. The rollers 18, 24 may however be disposed in a position exceeding 100% of the height of the magnetic brush 14 provided that the absolute value of an air gap is 1 mm or smaller, with the addition of an electric biasing means. While the outside diameters of the rollers 18, 24 may be selected as desired, they should be 80% or smaller of the outside diameter of the cylindrical sleeve 12 or in the range of from 5 to 60 mm or preferably from 8 to 40 mm. Since the amount of toner supplied to the magnetic brush 14 can be determined by the relative speed between the magnetic brush 14 and the toner supply roller 24, the amount of toner to be supplied may be controlled by varying the rotational speed of the toner supply roller 24. More specifically, the toner density may be detected by a known sensor, so that the rotational speed of the toner supply roller 24 can be controlled. Such a known sensor for detecting the toner density may be a means for detecting the reflected density of toner on the toner recovery roller 18 and calculating the toner density from the detected reflected toner density.

The toner layer limiting blade 26 may be disposed in pressed contact with the surface of the toner supply roller 24 which is diametrically opposite to the illustrated surface (FIG. 1). In such a modification, the toner supply roller 24 is rotated in the direction opposite to the direction of the arrow D.

An image developing method using the image developing apparatus shown in FIG. 1 is carried out as follows: The toner 25 in the toner hopper 23 is triboelectrically charged by the rotation of the toner supply roller 24 while at the same time the toner 25 is supplied as a thin uniform layer to the magnetic brush 14 under a prescribed toner supply biasing voltage. Then, the magnetic brush 14 supplied with the toner is moved toward the photosensitive drum 11 for developing an electrostatic latent image 16 formed on the photosensitive drum 11. After the image has been developed, there are toner density irregularities left on the magnetic brush 14 which correspond to the image. The remaining toner on the magnetic brush 14 is transferred to and recovered by the toner recovery roller 18 under a prescribed electric toner recovery bias. In U.S. Pat. Nos. 4,347,299 and 4,230,070, a toner recovery bias voltage commensurate with the density of an original document, i.e., toner consumption, is applied to keep the amount of supplied toner constant at all times. According to the present invention, however, toner is recovered until the toner density of the magnetic brush 14 is uniformized irrespective of the consumption of toner.

The toner density irregularities on the magnetic brush 14 are thus eliminated, and the toner density on the magnetic brush 14 is uniformized. More specifically, the magnetic brush 14 after toner recovery contains a carrier only or has a uniform toner density distribution, and is moved away from the toner recover roller 18 toward the toner supply roller 24.

Figure 2:
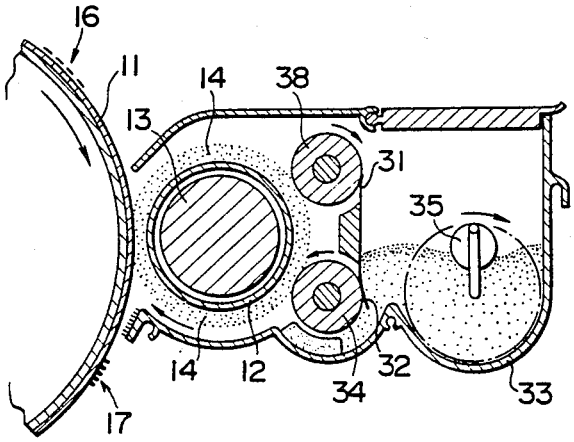
FIGS. 2 through 12 are vertical cross-sectional views of image developing apparatus according to other embodiments of the present invention.

FIG. 2 shows another embodiment in which a toner scraper blade 31 and a toner layer limiting blade 32 are pressed respectively against a toner recovery roller 38 and a toner supply roller 34, respectively. Toner is scraped off the toner recovery roller 38 by the toner scraper blade 31 and received in a toner tank 33 for efficient reuse. An agitator 35 is disposed in the toner tank 33 for prevent toner blocking which tends to be caused when a large amount of toner is supplied to the toner tank 33, for thereby increasing the stability of a developed image. Toner scraped off the toner recovery roller 38 by the toner scraper blade 31 should be directed in the vicinity of the agitator 35 for mixing the recovered toner and nely supplied toner highly efficiently.

Figure 3:
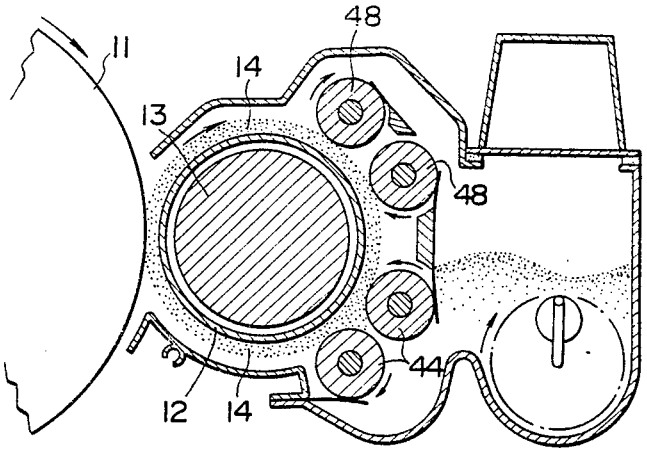

In FIG. 3 which shows still another embodiment, two toner recovery rollers 48 and two toner supply rollers 44 are disposed around the magnetic brush 14, the toner recovery rollers 48 being located upstream of the toner supply rollers 44 in the direction of rotation of the magnetic brush 14. The two toner recovery rollers 48 and the two toner supply rollers 44 are effective in sufficiently recovering and supplying toner. Images can therefore be developed stably without a reduction in density and image deterioration even when the magnetic brush 14 is rotated at an increased speed for high-speed copying and printing.

Figure 4:
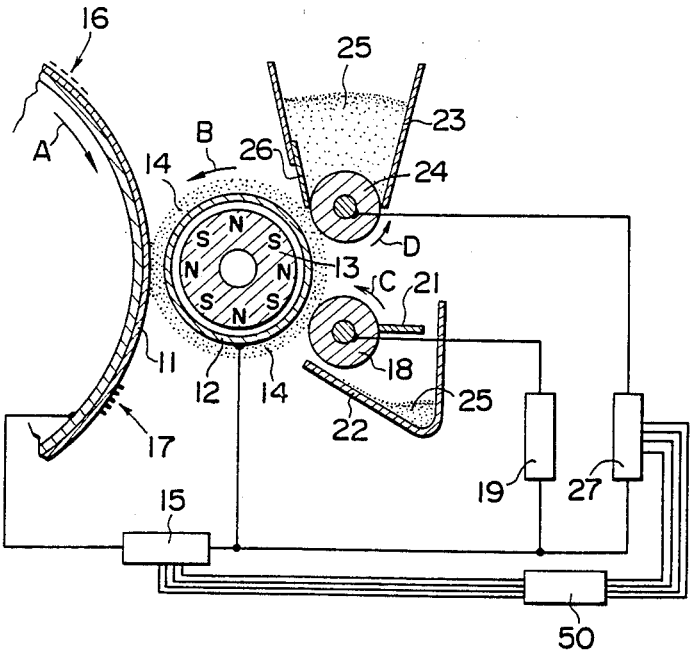

According to yet still another embodiment shown in FIG. 4, a power supply circuit 15 for applying an image developing bias voltage includes an encoder for producing a 4-bit signal indicative of the output bias voltage, and such a 4-bit output bias voltage is applied to a control device 50. The control device 50 includes a processing circuit for calculating a proper toner supplying bias voltage corresponding to the image developing bias voltage. An output signal from the control device 50 is applied to a power supply circuit 27 which produces a toner supplying bias voltage dependent on the output signal from the control device 50. The control device 50 controls the toner supplying bias voltage so that the difference between the image developing bias voltage and the toner supplying bias voltage will be constant at all times as shown in Table below.

| No. | Signal | Developing bias (V) | Supplying bias (V) |
|---|---|---|---|
| 1 | LLLL | −80 | +320 |
| 2 | LLLH | −100 | +300 |
| 3 | LLHL | −120 | +280 |
| 4 | LLHH | −140 | +260 |
| 5 | LHLL | −160 | +240 |
| 6 | LHLH | −180 | +220 |
| 7 | LHHL | −200 | +200 |
| 8 | LHHH | −220 | +180 |
| 9 | HLLL | −240 | +160 |
| 10 | HLLH | −260 | +140 |
| 11 | HLHL | −280 | +120 |
| 12 | HLHH | −300 | +100 |
| 13 | HHLL | −320 | +80 |
| 14 | HHLH | −340 | +60 |
| 15 | HHHL | −360 | +40 |
| 16 | HHHH | −380 | +20 |

Figure 5:
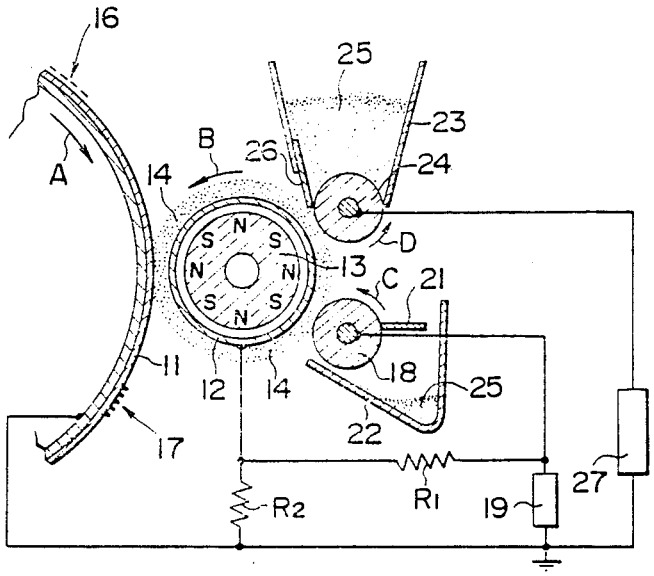

FIG. 5 illustrates a further embodiment of the present invention. In this embodiment, the toner recovery bias voltage applied by the power supply circuit 19 to the toner recovery roller 18 is divided by resistors R1, R2, and the divided voltage is applied as an image developing bias voltage to the cylindrical sleeve 12. The arrangement of FIG. 5 is of a simpler circuit structure for achieving the same operation and advantages as those of the previous embodiments.

Figure 6:
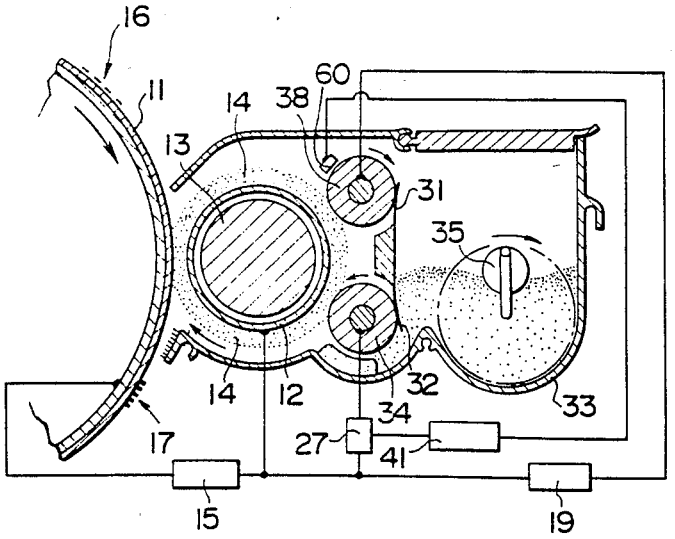

According to a still further embodiment shown in FIG. 6, a toner scraper blade 31 and a toner layer limiting blade 32 are pressed respectively against a toner recovery roller 38 and a toner supply roller 34, respectively. An image developing bias voltage is applied by the power supply circuit 15 to the cylindrical sleeve 12 and the photosensitive drum 11, and a toner recovery bias voltage is applied by the power supply circuit 19 to the toner recovery roller 38. A toner supplying bias voltage is impressed by the power supplying circuit 27 to the toner supply roller 34. An optical sensor 60 for detecting the amount of toner recovered from the magnetic brush 14 is associated with the toner recovery roller 38, and delivers a detected signal to a control device 41. The control device 41 includes a processing circuit for calculating a proper toner supplying bias voltage based on the detected signal from the sensor 60. An output signal from the control device 41 is applied to the power supply circuit 27. With this circuit arrangement, the amount of consumed toner and the amount of supplied toner are well balanced at all times.

Figure 7:
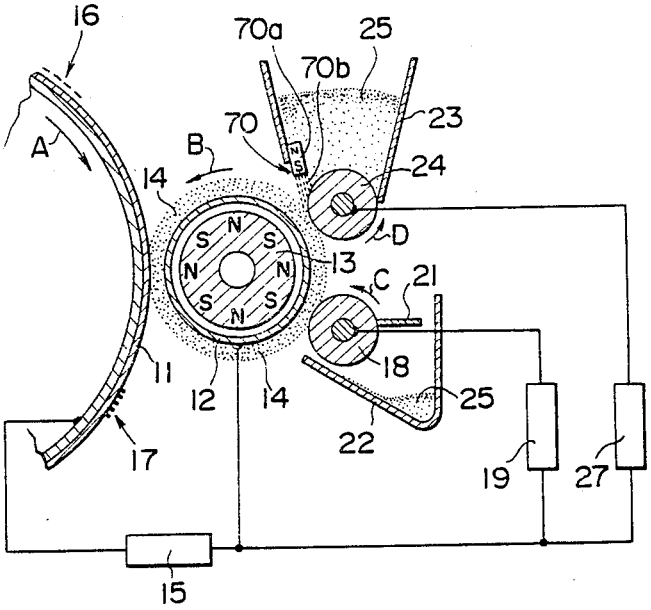

FIG. 7 shows a yet still further embodiment of the present invention. A toner layer limiting member 70 comprises a permanent magnet **70*a* as a means for generating a magnetic field, and magnetic carrier particles 70*b* held on magnetic lines of force that are produced by the permanent magnet 70*a*. The permanent magnet 70*a* is fixed to a peripheral edge of the lower opening of the toner hopper 23 and projects toward the toner supply roller 24. The magnetic carrier particles 70***b* extend from the projecting end of the permanent magnet 70*a* into the vicinity of the toner supply roller 24. The end of the magnetic carrier particles 70*b* and the outer peripheral surface of the toner supply roller 24 are slightly spaced from each other for limiting supplied toner as a thin uniform layer and also for triboelectrically charging the supplied toner as the toner passes through the gap between the end of the magnetic carrier particles 70*b* and the outer peripheral surface of the toner supply roller 24.

The toner 25 stored in the toner hopper 23 is thus delivered as a thin layer toward the magnetic brush 14 without leakage. The toner supply roller 24 is capable of uniformly limiting the heights of the brush fibers of the magnetic brush 14 for thereby eliminating image density irregularities. The magnetic field generating means of the toner layer limiting member 70 may be an electric means. In such an alternative, the electric means may utilize AC power to produce a magnetic field with its frequency selected not to impair the uniformity of the thin toner layer. Generally, the frequency may range from several tens to several hundreds Hz.

Furthermore, a limiting member such as a roller may be disposed closely to the sleeve 12 between the toner supply roller 24 and the photosensitive drum 11 for uniformly limiting the heights of the brush fibers of the magnetic brush 14.

Where the toner layer limiting member 70 is disposed in pressed contact with the surface of the toner supply roller 24 which is diametrically opposite to the illustrated surface (FIG. 7), the toner supply roller 24 is rotated in the direction opposite to the direction of the arrow D.

In operation, the toner 25 in the toner hopper 23 is retained on the toner supply roller 24 upon rotation thereof. The retained toner is then shaped into a thin uniform layer and triboelectrically charged by the magnetic carrier 70*b* of the toner layer limiting member 70. The thin layer of toner is thereafter supplied to the magnetic brush 14 under a prescribed toner supplying bias voltage.

Figure 8:
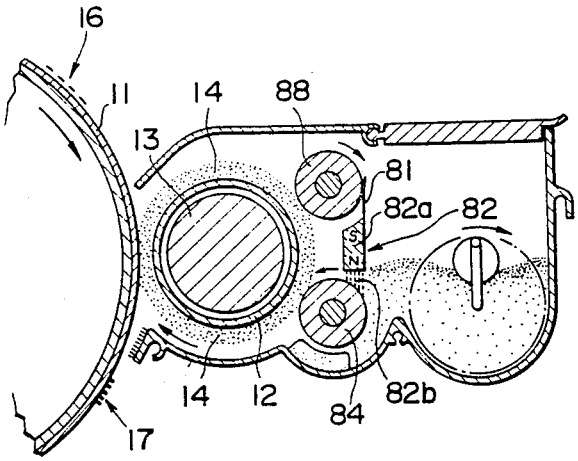

FIG. 8 show another embodiment of the present invention. A toner scraper blade 81 is pressed against a toner recovery roller 88, and a toner supply roller 84 is associated with a toner layer limiting member 82. The toner layer limiting member 82 comprises a permanent magnet 82*a* and magnetic carrier particles 82*b*.

Figure 9:
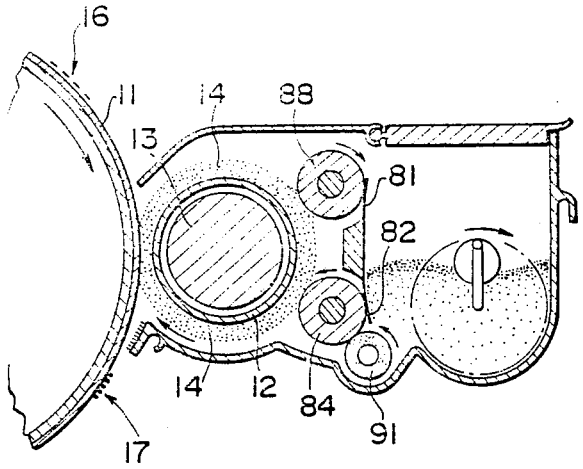

In still another embodiment of FIG. 9, a toner scraper blade 81 and a toner layer limiting blade 82 are pressed respectively against a toner recovery roller 88 and a toner supply roller 84. The toner supply roller 84 is held in contact with a rotatable resilient roller 91 as a toner scraper member. The toner scraper roller 91 comprises a metal core and a resilient body such as a foamed member disposed around the metal core. The toner scraper roller 91 is positioned such that it is elastically deformed against the toner supply roller 84 by a depth ranging from 0 to 2 mm. The depth of such elastic deformation should be varied dependent on the materials and sizes of the rollers involved. The resilient roller 91 is rotated in the same direction as that in which the toner supply roller 84 is rotated.

After toner has been supplied from the toner supply roller 84 to the magnetic brush 14, toner particles remaining on the toner supply roller 84 are fully scraped off by contact with the toner scraper roller 91. The toner supply roller 84 is therefore initialized by the toner scraper roller 91 for smoothly supplying toner continuously to the magnetic brush 14.

Where the toner scraper roller 91 is made of an electrically conductive material such as soft foamed urethane containing electrically conductive carbon, it can remove the electric charge of the remaining toner on the toner supply roller 84. This aids in scraping off the toner more efficiently, and keeps newly supplied toner well charged. The toner scraper roller 91 may be replaced with a brush-like member.

Figure 10:
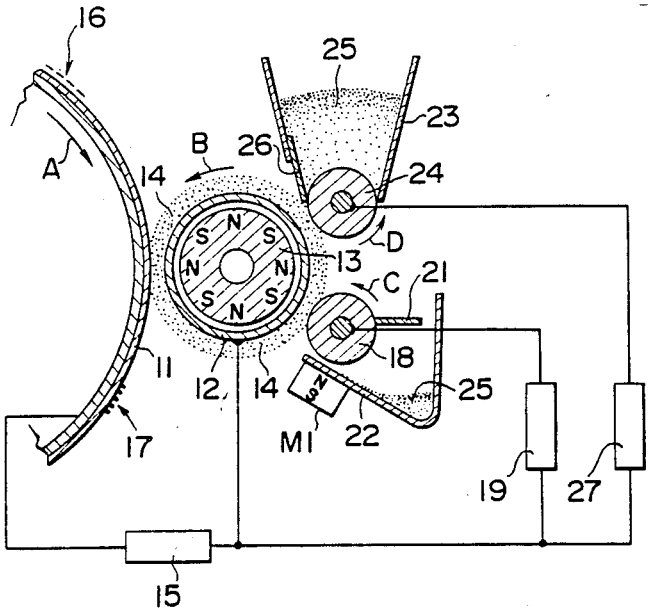

In FIG. 10 which shows still another embodiment, a hopper 22 is made of a nonmagnetic material and includes a slanted portion disposed near the peripheral surface of the toner recovery roller 18. The slanted portion of the hopper 22 is positioned downstream of a region in which the sleeve 12 and the toner recovery roller 18 are disposed closely to each other and upstream of the blade 21. A magnet M1 is mounted on the reverse side of the slanted portion of the, the magnet M1 having a length which is the same as the axial length of the toner recovery roller 18. The magnet M1 extends parallel to the toner recovery roller 18.

A carrier mixed in the toner recovered by the toner recovery roller 18 may be collected by the magnet M1 and retained on the inner surface of the hopper 22. The carrier is separated from the toner, and only the toner 25 is stored on the bottom of the hopper 22. Therefore, no carrier is present in the toner 25 which has been recovered by the toner recovery roller 18 and stored in the hopper 22. As a result, even when the toner 25 in the hopper 22 is placed in the toner hopper 23 for reuse, the toner layer limiting blade 26 and the toner supply roller 24 will not be damaged.

Figure 11:
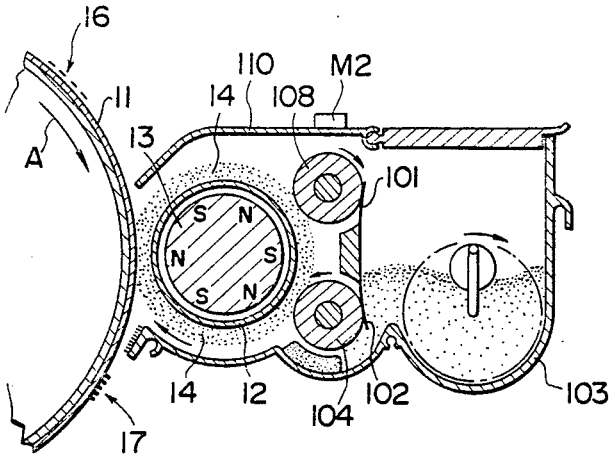

FIG. 11 illustrates a yet still further embodiment, which has a photosensitive drum 11, a cylindrical sleeve 12, a magnet 13, and a magnetic brush 14 that are identical to those of the embodiment of FIG. 10. However, the magnetic brush 14 is rotated in the opposite direction, i.e., clockwise. An electrostatic latent image 16 on the photosensitive drum 11 is converted to a positive, visible image in contact with the magnetic brush 14 upon movement with respect thereto.

A toner recovery roller 108 is positioned such that it will first contact the magnetic brush 14 after it has developed the image 16. A toner supply roller 104 is located downstream of the magnetic brush 14 in the direction of rotation thereof, the toner supply roller 104 being in contact with the magnetic brush 14. A toner scraper blade 101 and a toner layer limiting blade 102 are pressed respectively with the toner recovery roller 108 and the toner supply roller 104.

If a carrier were mixed in toner collected by the toner recovery roller 108, then it would damage the toner layer limiting blade 102 and the toner supply roler 104. To avoid such a problem, a magnet M2 is mounted on a non-magnetic cover 110 disposed directly over the toner recovery roller 108 for collecting a carrier in the toner. The carrier in the toner as it is recovered by the toner recovery roller 108 is magnetically attracted by the magnet M2 onto the reverse side of the cover 110. Therefore, no carrier is contained in the toner which is collected in the toner tank 108 for reuse, with the consequence that the toner supply roller 104 and the toner layer limiting blade 102 will not be damaged. The carrier attached on the reverse side of the cover 110 will thereafter be removed in a suitable manner.

Figure 12:
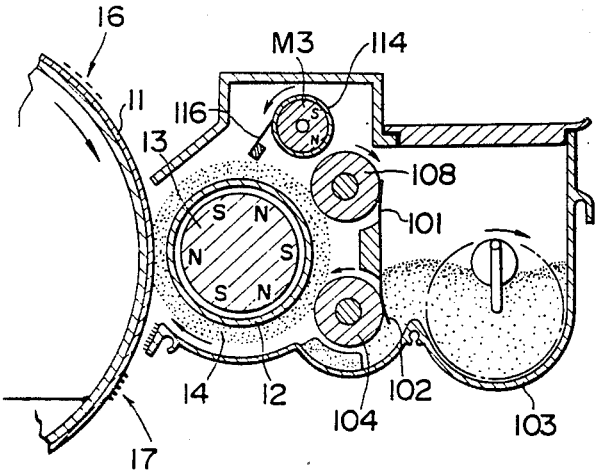

Another embodiment shown in FIG. 12 is similar to the embodiment of FIG. 11 except that a magnet M3 is disposed in the vicinity of the toner recovery roller 108 for preventing a magnetic carrier from being mixed in toner collected in a toner tank 103. The magnet M3 is of a cylindrical shape and has magnetic poles near the toner recovery roller 108, the magnet M3 being fixed to an immovable member in parallel relation to the roller 108.

The magnet M3 is surrounded by a nonmagnetic sleeve 114 which is rotated counterclockwise about its own axis by a drive means (described later). A scraper blade 116 is held in sliding contact with the peripheral surface of the sleeve 114. A carrier mixed in toner that has been retrieved from the magnetic brush 14 onto the toner recovery roller 108 is magnetically attracted to the sleeve 114. The carrier on the sleeve 114 is then moved upon rotation of the sleeve 114, and scraped off the sleeve 114 by the blade 116 onto the magnetic brush 14. Consequently, no carrier is mixed in the toner which has been recovered by the toner recovery roller 108 into the toner tank 103.

The carrier collected on the sleeve 114 is of a small amount. The peripheral speed of the sleeve 114 should preferably be low in order to prevent the collected carrier from being scattered around due to centrifugal forces produced upon rotation of the sleeve 114.

Figure 13:
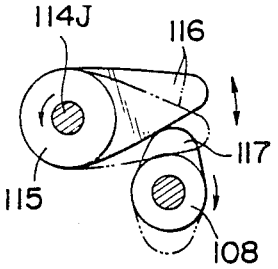
FIG. 13 is a side elevational view of a drive means for driving a rotatable roller.

FIG. 13 shows a drive means for rotating the sleeve 114. The sleeve 114 is integral with a rotatable shaft 114J coupled to a cam 116 through a one-way clutch 115. The toner recovery roller 108 has a rotatable shaft with a cam 117 mounted on an end thereof. The cam 116 is in engagement with the cam 117.

As the toner recovery roller 108 rotates, the cam 117 is rotated to vertically move the free end of the cam 116. The one-way clutch 115 transmits the angular movement of the cam 116 to the shaft 114 only when the free end of the cam 116 moves upwardly, so that the sleeve 114 is angularly moved intermittently about its own axis in the counterclockwise direction (FIG. 13). The speed of such intermittent angular movement of the sleeve 114 is of a relatively low value suitable for delivery of the carrier over the sleeve 114.

Figure 14:
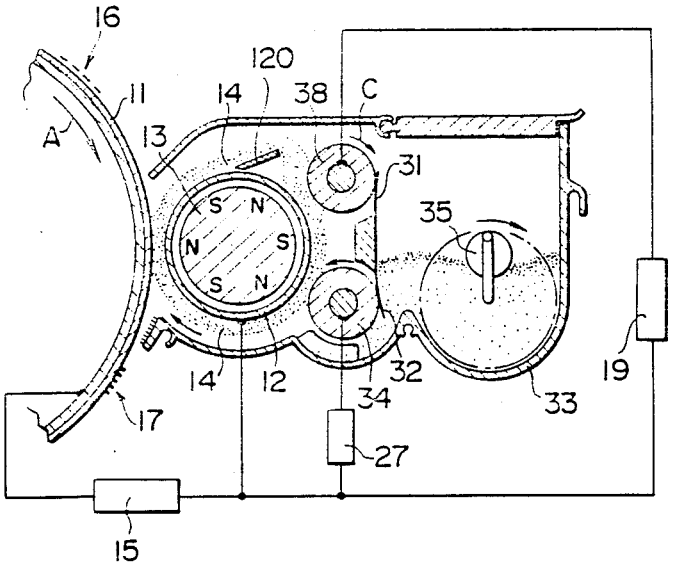
FIG. 14 is a vertical cross-sectional view of an image developing apparatus according to still another embodiment of the present invention.

FIG. 14 illustrates still another embodiment in which a plate 120 is positioned near the periphery of the image developing sleeve 12 and upstream of the toner recovery roller 18 in the direction of rotation of the sleeve 12. The plate 120 is located between the photosensitive drum 11 and the toner recovery roller 38, and has an end located closely or in contact with the sleeve 12. The plate 120 is inclined to a direction tangential to the sleeve 12 so as to be oriented in a direction opposite to the direction of rotation of the sleeve 12. The magnetic brush 14 on the sleeve 12, as it reaches the plate 120, is separated thereby off the peripheral surface of the sleeve 12. When this happens, upper and lower layers of chains of carrier and toner particles which constitute the magnetic brush 14 are switched around.

Figure 15:
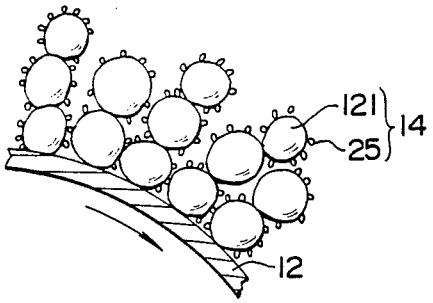
FIG. 15 is an enlarged fragmentary view of a magnetic brush.

More specifically, FIG. 15 shows on an enlarged scale the magnetic brush 14 on the sleeve 12 as it has passed through the image developing region. The magnetic brush 14 is composed of carrier particles 121 and toner particles 25. Upon rotation of the sleeve 12, the carrier particles 121 that form a chain-like brush are moved on the peripheral sleeve surface in the direction of the arrow. At this time, the upper and lower layers of the carrier particles 121 are not switched around. Therefore, the lower layer of the magnetic brush 14, i.e., the toner particles 25 near the peripheral surface of the sleeve 12 would not be available for image development, but would remain in the magnetic brush 14. As time goes on, such remaining toner particles would be fixed to the carrier particles 121 and the peripheral surface of the sleeve 12, thereby varying electric and physical properties of the carrier particles 121 and the sleeve 12. As a consequence, the image developing conditions would be changed and the efficiency of toner supply and recovery would be lowered. The toner particles accumulated in the magnetic brush 14 would gradually vary in their charges, thus causing toner deposits or stains on the background of a copied image and scattering of the toner.

The above problem is solved by the plate 120 which separates the carrier particles 121 and the toner particles 25 off the peripheral surface of the sleeve 12. As another means, the magnet 13 may be differently arranged to separte the magnetic brush 14 off the sleeve 12 under magnetic forces, or to switch around the layers while the magnetic brush 14 is being formed on the sleeve 12. In this manner, the magnetic brush 14 can stably formed on the sleeve at all times.

Figure 16:
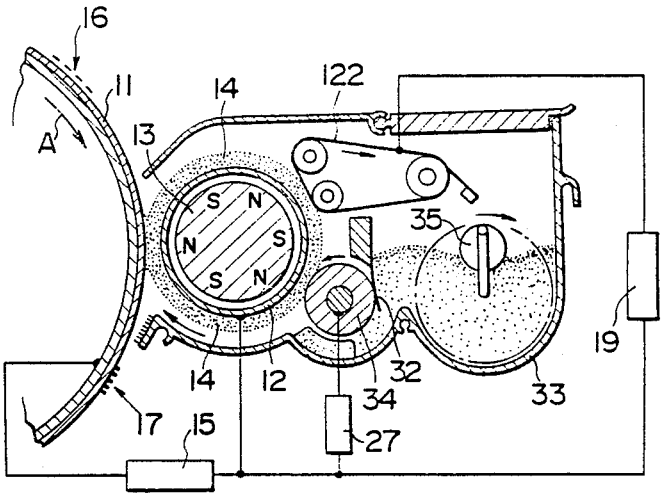
FIGS. 16 through 20 are vertical cross-sectional views of image developing apparatus according to other embodiments of the present invention.

A further embodiment shown in FIG. 16 is similar to the embodiment of FIG. 14 except that the plate 120 of FIG. 14 is dispensed with and the toner recovery roller 38 of FIG. 14 is replaced with an electrically conductive belt 122. Inasmuch as the principal developing process is the same as that of FIG. 14, the belt 122 will mainly be described below.

The belt 122 is trained around rotatable rollers so as to travel in the direction of the arrow. The magnetic brush 14 that has been utilized for image development in the image developing region is brought into contact with the belt 122, which recovers toner from the magnetic brush 14. The toner attached to the belt 122 by an electric bias is delivered with the belt 122 which travels in the direction of the arrow, and is caused by a blade to fall off the belt 122 into the toner tank 33. The toner collected in the toner tank 33 is then agitated by the agitator 35 and mixed with the existing toner for reuse.

Since the recovered toner has been electrically charged, it cannot be well mixed with the existing toner in the toner tank 33. If the charged toner were supplied by the toner supply roller 34 to the magnetic brush 14, the toner on the photosensitive drum 11 would be differently charged, and it would be highly likely to result in a reduction in the image quality such as image density irregularities. To eliminate this drawback, it is necessary to deliver the recovered toner as deeply into the toner tank 33 as possible so that it can well be agitated and mixed with the existing toner.

Where the belt 122 is employed as a toner recovery means as shown in FIG. 16, the recovered toner may be transferred deeply into the toner tank 33 by suitably selecting the positions of the rollers around which the belt 122 is trained, for sufficient toner agitation and mixing. It is easily possible to increase the area of the belt 12 for contact with the magnetic brush 14 by increasing the distance between the adjacent rollers near the magnetic brush 14. Therefore, toner can be recovered more efficiently than possible with the arrangement of FIG. 14. The belt 122 may be made of any material insofar as it can electricaly be biased.

Figure 17:
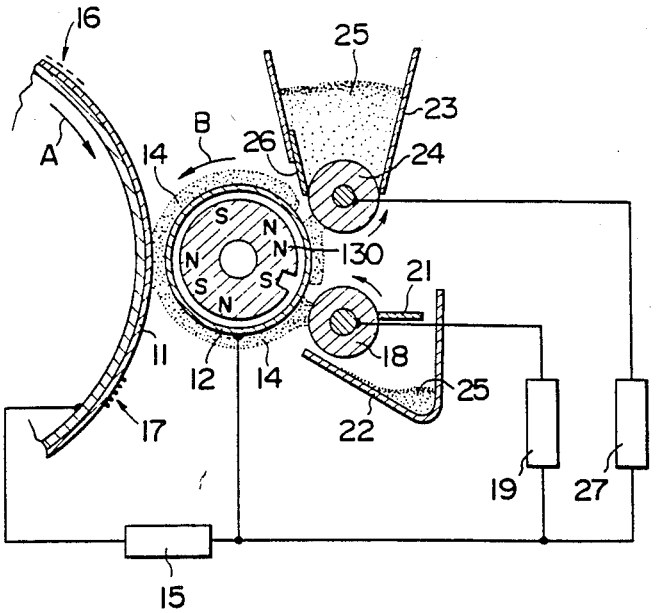

FIG. 17 shows a still further embodiment of the present invention. The embodiment of FIG. 17 differs from the embodiment of FIG. 1 in that the sleeve 12 has surface areas in which no magnetic brush is formed in confronting relation to the toner recovery and supply rollers.

A magnet 130 has two like magnetic poles N adjacent to each other and opposite to the toner supply roller 24. No magnetic brush is formed in the surface area of the sleeve 12 over the two like magnetic poles N. The magnet 130 also has an axial recess defined in the peripheral surface thereof in opposite relation to the toner recovery roller 18. No magnetic brush is formed in the surface area of the sleeve 12 over the recess in the sleeve 12.

With this arrangement, portions of the magnetic brush 14 which are located immediately upstream of the sleeve surface areas free of the magnetic brush 14 in the direction of rotation thereof are raised radially outwardly for increased contact with the rollers 18, 24, so that the toner can be supplied and recovered highly efficiently for effectively keeping a desired image quality. It is practically sufficient for the magnetic forces in the areas free from the magnetic brush to be 100 to 200 gausses lower than the magnetic forces in portions on opposite sides of those areas.

Figure 18:
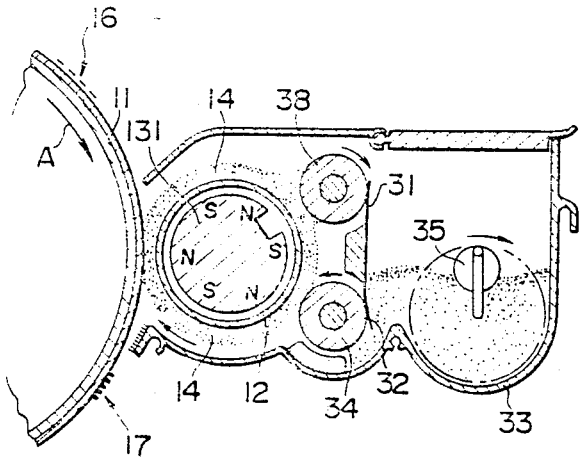

FIG. 18 shows a yet still further embodiment of the present invention. The embodiment of FIG. 18 is similar to that of FIG. 14 except that the sleeve 12 has a surface area in which no magnetic brush is formed in confronting relation to the toner recovery roller 38. More specifically, a permanent magnet 131 has an axial recess defined in the peripheral surface thereof in opposite relation to the toner recovery roller 38. A plate identical to the plate 120 of FIG. 14 may be added if necessary. While no means for applying an image developing bias voltage is shown in FIG. 18, operation and advantages of the arrangement of FIG. 18 are the same as those of FIG. 14.

Figure 19:
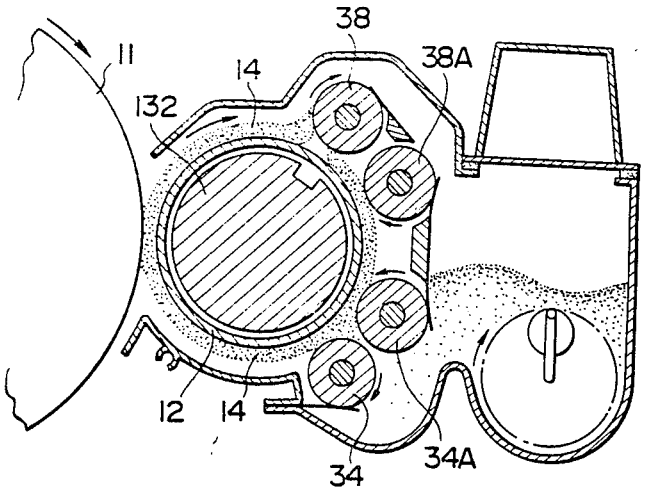

Another embodiment illustrated in FIG. 19 is a modification of the embodiment of FIG. 18. An auxiliary roller 38A is disposed downwardly and rightwardly of and adjacent to the toner recovery roller 38, and another auxiliary roller 34A is disposed upwardly and rightwardly of and adjacent to the toner supply roller 34. A permanent magnet 132 disposed in the sleeve 12 has an axial recess defined in the outer periphery thereof for forming a magnetic-brush-free portion on the sleeve 12 in opposite relation to the axial recess of the permanent magnet 132. The magnetic brush 14 has a raised portion positioned immediately upstream of the magnetic-brush-free portion in the direction of rotation of the magnetic brush 14, and such a raised portion makes good contact with the toner recovery roller 38.

The auxiliary rollers 38A, 34A assist in sufficiently recovering and supplying toner even when the magnetic brush 14 rotates at a high speed. Thus, the apparatus shown in FIG. 19 is effective in producing stable copies and prints free of density reductions and image deteriorations in high-speed copying and high-speed printing processes.

In each of the embodiments of FIGS. 18 and 19, the sleeve 12 may have a magnetic-brush-free portion thereon in opposite relation to the toner supply roller 34 by defining an axial recess in the permanent magnet 131 or 132, positioning magnetic poles of one polarity adjacent to each other in the permanetic magnet 131 or 132.

Figure 20:
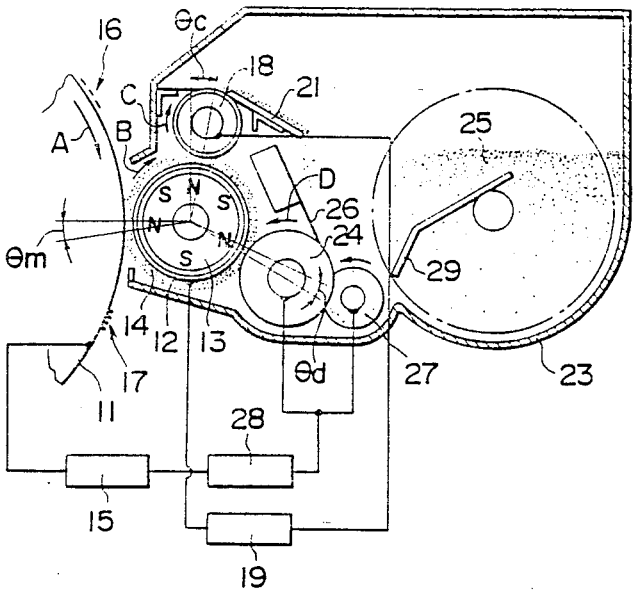

In still another embodiment shown in FIG. 20, one of the magnetic pole centers of the permanent magnet or magnet roller 13 which forms the magnetic brush 14 is located upstream, in the direction of travel of the magnetic brush 14 as indicated by the arrow B, of the center of an image developing region defined between the magnetic brush 14 and the photosensitive drum 11, i.e., the narrowest portion of the image developing region. Stated otherwise, the center of the magnet roller 13 and the center of the photosensitive drum 11 are interconnected by a central joint line, and the magnetic pole center line of the magnet roller 13 is positioned on the negative side of such a central joint line. That is, a so-called developing main pole angle $\theta_m$ is negative. "Negative" and "positive" used herein are defined as follows: The center of the image developing region, i.e., the central joint line, with which the center of the maganet roller 13 is aligned, is referred to as a zero point. With respect to the direction of travel of the magnetic brush 14, the negative side is disposed upstream of the zero point, and the positive side is disposed downstream of the zero point.

Another magnetic pole center of the magnet roller 13 is located upstream, in the direction of travel of the magnetic brush 14, of the center of a toner recovering region defined between the magnetic brush 14 and the toner recovery roller 18, i.e., the narrowest portion of the toner recovering region. Stated otherwise, the center of the magnet roller 13 and the center of the toner recovery roller 18 are interconnected by a central joint line, and the magnetic pole center line of the magnet roller 13 is positioned on the negative side of such a central joint line. That is, a magnetic pole angle $\theta_c$ is negative. "Negative" and "positive" used herein are defined as follows: The center of the toner recovering region, i.e., the central joint line, with which the center of the maganet roller 13 is aligned, is referred to as a zero point. With respect to the direction of travel of the magnetic brush 14, the negative side is disposed upstream of the zero point, and the positive side is disposed downstream of the zero point.

The scraper plate 21 is disposed closely to the toner recovery roller 18 for scraping recovered toner off the toner recovery roller 18. The scraped toner is returned into a toner hopper 23.

The toner supply roller 24 is disposed downwardly and rightwardly of the cylindrical sleeve 12 and held in contact with the magnetic brush 14. A magnetic pole center of the magnet roller 13 is located upstream, in the direction of travel of the magnetic brush 14, of the center of a toner supplying region defined between the magnetic brush 14 and the toner supply roller 24, i.e., the narrowest portion of the toner supplying region. Stated otherwise, the center of the magnet roller 13 and the center of the toner supply roller 24 are interconnected by a central joint line, and the magnetic pole center line of the magnet roller 13 is positioned on the negative side of such a central joint line. That is, a magnetic pole angle $\theta_d$ is negative. "Negative" and "positive" used herein are defined as follows: The center of the toner supplying region, i.e., the central joint line, with which the center of the maganet roller 13 is aligned, is referred to as a zero point. With respect to the direction of travel of the magnetic brush 14, the negative side is disposed upstream of the zero point, and the positive side is disposed downstream of the zero point.

The toner supply roller 24 is driven by a drive mechanism (not shown) to rotate about its own axis in the direction of the arrow D for feeding toner 25 from the toner hopper 24 toward the magnetic brush 14.

A toner layer limiting blade 26 is pressed against the toner supply roller 24 for depositing a uniform film or layer of toner 25 on the toner supply roller 24 and triboelectrically charging the toner 25. A resilient roller 27 is disposed in contact with the toner supply roller 24 for triboelectrically charging the toner 25 more effectively.

A bias voltage for supply toner is applied by a power supply circuit 28 to the toner supply roller 24 and the resilient roller 27 for well transferring the toner 25 to the magnetic brush 14.

Such a hybrid-type image developing apparatus operates as follows: The toner 25 in the toner hopper 23 is delivered to and retained on the toner supply roller 24 as the toner supply roller 24 and the resilient roller 27 are rotated. The retained toner is shaped into a uniform thin film and triboelectrically charged by the toner layer limiting blade 26.

Figures 21A, 21B, 21C:
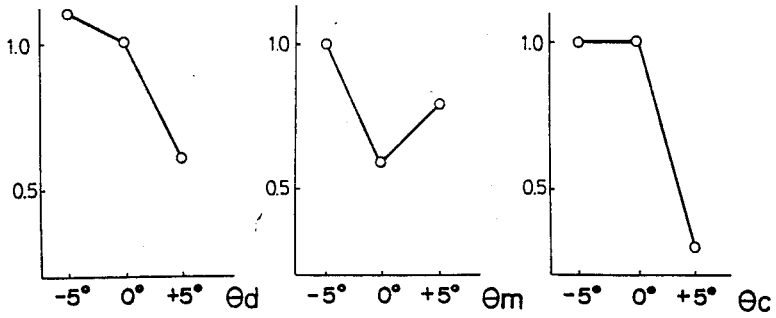
FIGS. 21*a*, 21*b*, and 21*c* are graphs each showing the relationship between magnetic pole angles and image densities.

Under a prescribed toner supplying bias voltage, the toner 25 is supplied as a uniform thin layer to the magnetic brush 14. At this time, the toner is supplied uniformly and effectively to the magnetic brush 14. More specifically, FIG. 21*a* shows the relationship between the magnetic pole angle $\theta_d$ indicated on the horizontal axis and the image density indicated on the vertical axis. It will be seen from FIG. 21*a* that when the magnetic pole angle $\theta_d$ is negative, the toner is supplied more effectively. This is because where the magnetic pole center is located upstream of the narrowest portion of the toner supplying region, a mass of brush fibers is formed upstream of the narrowest portion of that region, which are effective in taking up various mechanical variations such as the eccentricities of the rollers for thereby allowing the toner supply roller 24 to be held in stable contact with the magnetic brush 14.

The magnetic brush 14, to which the toner has been supplied, is transferred toward the photosensitive drum 11 for developing an electrostatic latent image 16 formed on the drum 11. At this time, the image can be developed uniformly and effectively without from density irregularities and has reduced toner deposits or contamination on the background of the image. More specifically, FIG. 21*b* shows the relationship between the magnetic pole angle $\theta_m$ indicated on the horizontal axis and the image density indicated on the vertical axis. It will be seen from FIG. 21*b* that when the magnetic pole angle $\theta_m$ is negative, the image is developed more effectively. This is because where the magnetic pole center is located upstream of the narrowest portion of the image developing region, a mass of brush fibers is formed upstream of the narrowest portion of that region, which are effective in taking up various mechanical variations such as the eccentricities of the rollers for thereby allowing the photosensitive drum 11 to be held in stable contact with the magnetic brush 14.

After the image has been developed, the magnetic brush 14 has toner density differences or irregularities corresponding to the image. The residual toner on the magnetic brush 14 is transferred to the toner recovery roller 18 by a toner recovering electric bias. At this time, the toner can be recovered uniformly and effectively. More specifically, FIG. 21*c* illustrates the relationship between the magnetic pole angle $\theta_c$ indicated on the horizontal axis and the image density indicated on the vertical axis. It will be seen from FIG. 21*c* that when the magnetic pole angle $\theta_c$ is negative, the toner is recovered more effectively. This is because where the magnetic pole center is located upstream of the narrowest portion of the toner recovering region, a mass of brush fibers is formed upstream of the narrowest portion of that region, which are effective in taking up various mechanical variations such as the eccentricities of the rollers for thereby allowing the toner recovery roller 18 to be held in stable contact with the magnetic brush 14. As a result, the magnetic brush 14 is initialized for a better toner supplying capability.

Through the above process, toner density differences or irregularities on the magnetic brush 14 are eliminated and the toner density is uniformized on the magnetic brush 14. After the toner recovery, the magnetic brush 14 with only a carrier or a uniform toner density distribution is moved away from the toner recovery roller 18 toward the toner supply roller 24.

Figure 22:
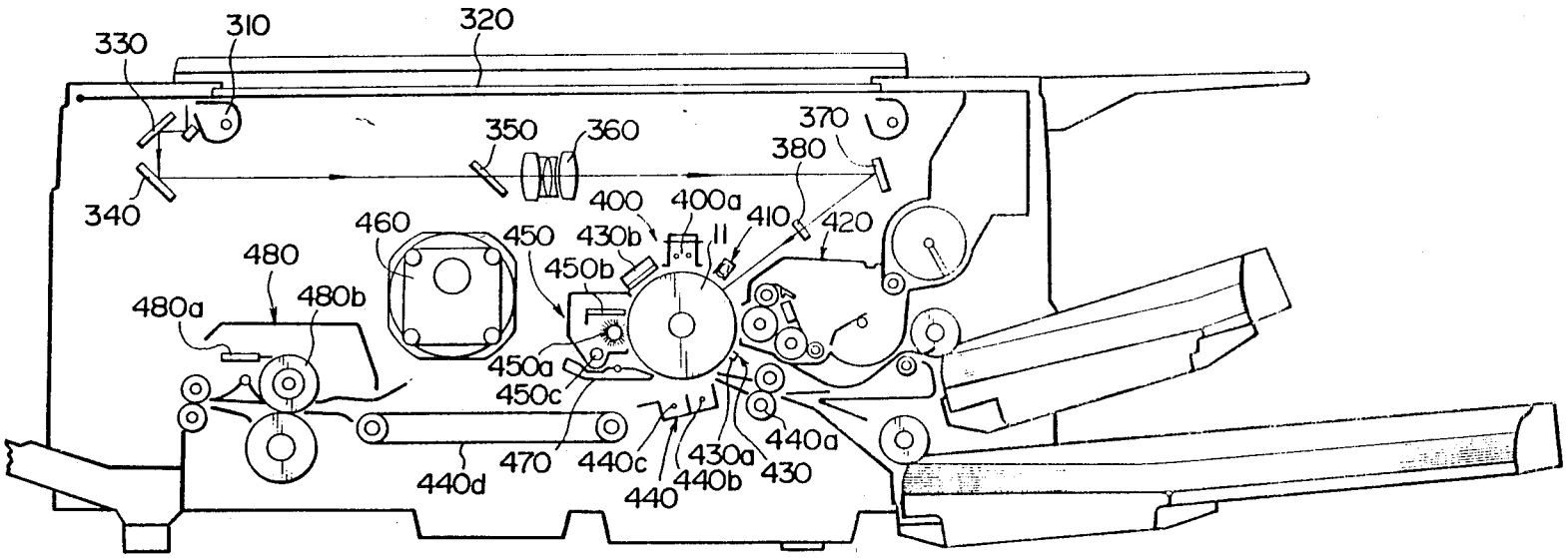
FIG. 22 is a vertical cross-sectional view of a copying machine incorporating an image developing apparatus of the present invention.

A copying machine employing the image developing apparatus of the present invention will be described with reference to FIG. 22.

The copying machine has an optical system in which light emitted from a halogen lamp 310 is applied to and reflected from an original document 320 to be copied. The reflected light then travels successively via a first mirror 330, a second mirror 340, a third mirror 350, a lens 360, a fourth mirror 370, and a dust-resistant glass plate 380, before the light is focused on a photosensitive drum 11. The dust-resistant glass plate 380 serve to prevent dust particles from entering the optical system. The optical system includes a variable-magnification device for varying the optical magnification from a minimum of 50% to a maximum of 200% in increments of 1%. The copying machine also includes an automatic density adjusting system for producing images of clean backgrounds by detecting the background density of the document 320 with an optical fiber and correcting an image developing bias based on the detected background density.

Around the photosensitive drum 11, there are disposed a charger unit 400, an eraser 410, an image developing apparatus 420, a discharger unit 430, an image transfer and sheet separator unit 440, and a cleaning unit 450.

In the charger unit 400, a high voltage is applied to a charging wire in a dark environment to produce a corona discharge for uniformly negatively charging the photosensitive drum 11 to a potential of −800 V. Air is introduced from the front side of a charger 400*a* of the charger unit 400 for increasing the discharging efficiency. The charging wire is of a diameter of 0.08 mm and has a carbon coating on its surface. A grid is disposed between the charging wire and the photosensitive drum 11 for controlling the charging potential at a uniform and constant level. A charger cleaner is also provided for removing any dirt from the charger 400*a* by detaching the charger 400*a*.

The eraser 410 serves to applying light to the photosensitive drum 11 to remove unwanted charges therefrom for thereby permitting easy cleaning of the drum 11. The eraser 410 is composed of an elongated LED for erasing at its sides and tip end. The eraser 410 includes an erase substrate to which two thermistors are attached for bias correction.

The image developing apparatus 420 is of the same construction as that shown in FIG. 20.

The discharger unit 430 has a pre-transfer discharging lamp 430*a* and a discharging lamp 430*b*. These lamps 430*a*, 430*b* are energized at the same time as when a main motor 460 is started, to apply light diffused by filters to the photosensitive drum 11 for removing residual charges therefrom. The pre-transfer discharging lamp 430*a* comprises a cold-cathode tube.

The image transfer and sheet separator unit 440 keeps a sheet from a resist roller 440*a* in intimate contact with the photosensitive drum 11 for transferring toner from the drum 11 onto the sheet with a transfer charger 440*b*. At the same time, the image transfer and sheet separator unit 440 separates the sheet from the photosensitive drum 11 with a separator charger 440*c*. Should the sheet fail to be separated from the drum 11 by the separator charger 440*c*, the sheet will be forcibly separated by a separator finger 470. The separated sheet is delivered by a conveyor belt 440*d* into an image fixing device 480.

The cleaning unit 450 has a fur brush 450*a* and a cleaning blade 450*b* for scraping residual toner off the photosensitive drum 11. The cleaning blade 450 is supported at its center so that it can be held against the photosensitive drum 11 under uniform lateral pressure. The fur brush 450*a* is rotated in the same direction as that of rotation of the photosensitive drum 11, and serves to remove foreign matter such as paper pieces which the cleaning blade 450*b* happens to fail to take off the drum 11. The toner which has been scraped off the drum 11 by the fur brush 450*a* and the cleaning blade 450 is discharged out of the copying machine by a toner recovery coil 450*c* and collected in a bottle (not shown).

The image fixing device 480 applies heat and pressure to the sheet delivered by the conveyor belt 440*d* to fuse the toner on the sheet. The image fixing device 480 includes a heater roller 480*b* that is heated by electric power of 750 W under 100 V. The temperature of the heater roller 480*b* is controlled by a thermistor 480*a* which detects the temperature of the heater roller 480*b*.

Figure 23:
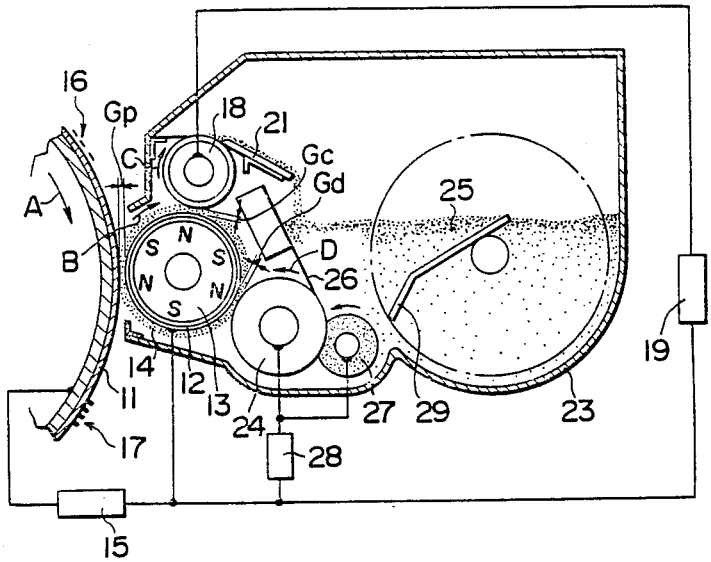
FIG. 23 is a vertical cross-sectional view of an image developing apparatus according to a further embodiment of the present invention.

FIG. 23 shows yet another embodiment of the present invention. A photosensitive drum 11 used in this embodiment is made of an organic photosensitive material (OPC), and an electrostatic latent image formed thereon has a negative polarity. Therefore, toner used for developing such an electrostatic latent image is charged to a positive polarity.

A cylindrical sleeve 12 serving as a developer support is disposed near the photosensitive drum 11 with a gap Gp left therebetween. The cylindrical sleeve 12 is made of a nonmagnetic material such as aluminum or the like. An image developing bias voltage is applied to the sleeve 12 to prevent toner from being deposited on the background of a copied image and also to adjust the density of the image. In the embodiment of FIG. 23, the latent image potential is set to −800 V, the background potential is set to −50 V, and the image developing bias voltage is set to −150 V.

A toner recovery roller 18 for recovering residual toner from a magnetic brush 14 after the image has been developed is disposed upwardly of the cylindrical sleeve 12 with a gap Gc left therebetween.

A bias voltage is applied by a power supply circuit 19 to the toner recovery roller 18 for recovering toner from the magnetic brush 14. The toner recovering bias voltage is of the same polarity, i.e., the negative polarity, as that of the latent image, and is of a level which is the same as that of the image developing potential, i.e., high enough to develop the entire image if the toner recovery roller 18 were used as a latent image carrier. The toner recovering bias voltage is selected to range from −100 to −400 V in the present embodiment.

The toner recovery roller 18 is driven to rotate clockwise in the direction of the arrow C about its own axis for preventing recovered toner from being redeposited on the magnetic brush 14. A scraper blade 21 is associated with the toner recovery roller 18 for scraping recovered toner off the toner recovery roller 18 and feeding the scraped toner into a toner hopper 23.

A toner supply roller 24 is disposed downwardly and rightwardly of the cylindrical sleeve 12 with a gap Gd left therebetween. The gap Gd between the toner supply roller 24 and the cylindrical sleeve 12 is equal to or smaller than the gap Gc between the cylindrical sleeve 12 and the toner recovery roller 18 and the gap Gp between the cylindrical sleeve 12 and the photosensitive drum 11 ($Gd \leqq Gc, Gp$).

An auxiliary roller 27 is held against the toner supply roller 24 for assisting in charging toner on the toner supply roller 24. A bias voltage is applied by a power supply circuit 28 to the toner supply roller 24 and the auxiliary roller 27 for effectively supplying toner from the toner supply roller 24 to the magnetic brush 14. The toner supplying bias voltage is of the polarity opposite to that of the latent image, i.e., the same polarity as that of the charged toner, and is of a level ranging from +50 to +400 V. The value of the toner supplying bias voltage may vary dependent on the properties of the toner, the performance of the toner supply roller, the resistance of the carrier, the chargeability of the carrier, and the like.

Operation of the image developing apparatus shown in FIGS. 23 is as follows: Toner 25 is fed from the toner hopper 23 by the toner supply roller 24 and the auxiliary roller 27 as they rotate to the toner supply roller 24. The supplied toner 25 is shaped into a uniform thin layer and triboelectrically charged by a toner layer limiting blade 26.

The toner 25 is then supplied as a uniform thin layer from the toner supply roller 24 to the magnetic brush 14 under the toner supplying bias voltage. Since the gaps Gd, Gc, Gp are selected to meet the relationship: $Gd \leqq Gc, Gp$, a toner mass is formed upstream of the toner supply roller 24 for supplying the toner uniformly and effectively o the magnetic brush 14.

If the gap Gd were larger than the gap Gp ($Gd > Gp$), then a toner mass would be formed between the cylindrical sleeve 12 and the photosensitive drum 11, particularly downstream of the photosensitive drum 11. As a result, no sufficient toner supply capability would be achieved between the toner supply roller 24 and the magnetic brush 14, failing to supply the toner well and hence resulting in a reduction in the image density and/or image irregularities. If the gap Gd were larger than the gap Gc ($Gd > Gc$), then the magnetic brush near the toner supply roller 24 would not function sufficiently, also failing to supply the toner well and hence resulting in a reduction in the image density and/or image irregularities.

The magnetic brush 14 to which the toner has been supplied is transferred toward the photosensitive drum 11 for developing an electrostatic latent image 16 formed on the photosensitive drum 11.

After the image has been developed, toner density differences or irregularities corresponding to the image remain on the magnetic brush 14. The residual toner on the magnetic brush 14 is thereafter recovered by the toner recovery roller 18 under a toner recovering bias. The toner recovering bias may be adjusted to a suitable value for uniform and effective toner recovery.

Figure 24:
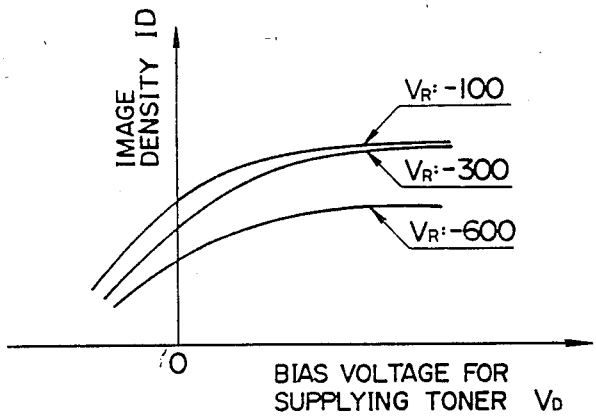
FIG. 24 is a graph illustrating the relationship between bias voltages and image densities.

FIG. 24 shows the relationship between the bias voltages $V_R$, $V_D$ applied respectively to the toner recovery roller 18 and the toner supply roller 24 and the image density ID. The image density ID is indicated on the vertical axis, whereas the toner supplying bias $V_D$ is indicated on the horizontal axis, with the toner recovering bias $V_R$ used as a parameter.

As the toner supplying bias $V_D$, which is of the same positive polarity as that of the charged toner, is increased, the amount of toner supplied from the toner supply roller 24 to the magnetic brush 14 is increased, and so is the image density ID. However, when the toner supplying bias $V_D$ exceeds a certain value, the image density ID remains the same and does not increase.

When the absolute value of the toner recovering bias $V_R$ is increased, the amount of toner recovered from the magnetic brush 14 is increased, and the image density ID is lowered. If the absolute value of the toner recovering bias $V_R$ were too large, not only irregular toner densities on the magnetic brush 14 upon image development would be eliminated, but almost entire toner would be recovered from the magnetic brush 14. As a consequence, toner involved in developing the image would be limited to that supplied from the toner supply roller 24 to the magnetic roller 14, so that the image density ID would be lowered as shown in FIG. 24. If the absolute value of the toner involved in developing the image would be limited to that supplied from the toner supply roller 24 to the magnetic roller 14, so that the image density ID would be lowered as shown in FIG. 24. If the absolute value of the toner recovering bias $V_R$ were too small, it would be unable to sufficiently eliminate toner density irregularities on the magnetic brush 14. Inasmuch as the amount of toner that the carrier can hold on the magnetic brush 14 is constant, the image density ID could not be increased beyond a certain value even if the toner recovering bias $V_R$ were reduced to zero volt or its absolute value were lowered beyond a certain value at the same polarity as that of the toner. If the absolute value of the toner recovering bias $V_R$ were too small, the image density ID would no longer be increased, and toner would excessively be supplied and would not be recovered sufficiently, with the result that the toner would be scattered around or other difficulties would arise.

According to the embodiment of FIG. 23, the toner supplying bias voltage $V_D$ is selected to be in the range of from +50 to +400 V, and the toner recovering bias voltage $V_R$ is in the range of from −100 to −400 V, as described above, for making these bias voltages $V_D$, $V_R$ well balanced. Where an original document having a large solid black area is to be copied and hence large toner consumption is expected, the amount of toner recovered may be reduced in the manner similar to that described with reference to FIG. 6, and the bias voltages may be varied in order to increase the amount of toner supplied, so that stable images can be produced.

Figure 25:
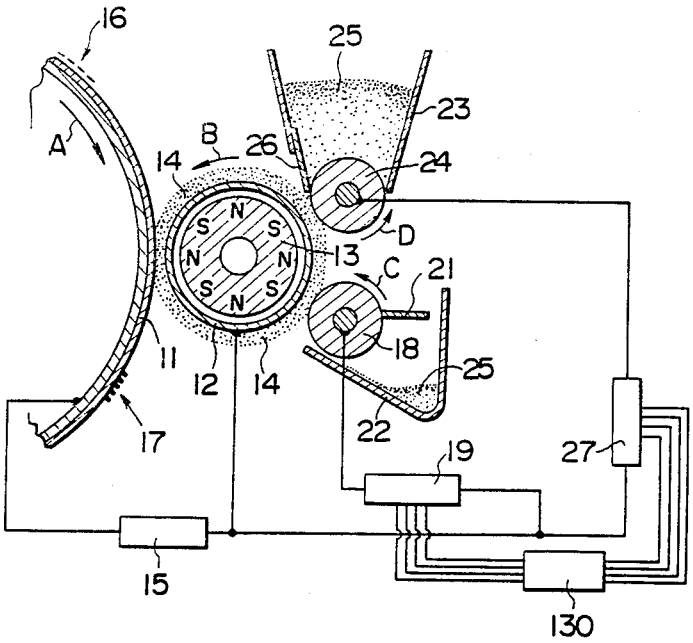
FIGS. 25 and 26 are vertical cross-sectional views of image developing apparatus according to other embodiments of the present invention.

According to a further embodiment illustrated in FIG. 25, a power supply circuit 19 for applying a toner recovering bias voltage includes an encoder for producing a 4-bit signal indicative of a toner recovering bias current, and such a 4-bit signal is applied to a control device 130. The control device 130 includes a processing circuit for calculating a proper toner supplying bias voltage corresponding to the toner recovering bias current. An output signal from the control device 130 is applied to a power supply circuit 27 which produces a toner supplying bias voltage dependent on the output signal from the control device 130. The toner recovering bias current flows through the sleeve 12, the magnetic brush 14, and the toner recovery roller 18. The electric resistance of the magnetic brush 14 varies dependent on the amount of toner contained in the magnetic brush 14. The control circuit 130 controls the power supply circuit 27 so that when an output signal representing a toner recovering bias current corresponding to no toner in the magnetic brush 14 is produced, a maximum toner supplying bias voltage is generated by the power supply circuit 27, and when an output signal representing a toner recovering bias current corresponding to saturated toner in the magnetic brush 14 is produced, a minimum toner supplying bias voltage is generated by the power supply circuit 27, as indicated by Table below.

| No. | Signal | Recovering current (μA) | Supplying bias (V) |
|---|---|---|---|
| 1 | LLLL | 32 | +300 |
| 2 | LLLH | 30 | +250 |
| 3 | LLHL | 28 | +200 |
| 4 | LLHH | 26 | +150 |
| 5 | LHLL | 24 | +100 |
| 6 | LHLH | 22 | +80 |
| 7 | LHHL | 20 | +60 |
| 8 | LHHH | 18 | +40 |
| 9 | HLLL | 16 | +20 |
| 10 | HLLH | 14 | +10 |
| 11 | HLHL | 12 | +5 |
| 12 | HLHH | 10 | 0 |
| 13 | HHLL | 8 | −25 |
| 14 | HHLH | 6 | −50 |
| 15 | HHHL | 4 | −100 |
| 16 | HHHH | 2 or below | −200 |

More specifically, the control device 130 detects the amount of toner recovered, calculates a suitable amount of toner to be supplied based on a single representative of the detected amount of recovered toner, and controls the bias voltage issued from the power supply circuit 27 so as to vary dependent on the amount of recovered toner. A means for detecting the amount of recovered toner and issuing the above signal indicative of the detected toner amount comprises a sensor compound of a light source such as an LED for illuminating the toner recovered by the toner recovery roller 18, and a light detector such as a CDS for detecting light from the light source that has passed through the recovered toner. The amount of light having passed through the recovered toner is indicative of the amount of recovered toner since it varies with the toner amount (toner density) recovered on the toner recovery roller 18.

In the above embodiment, the toner supplying bias voltage given by the power supply circuit 27 is controlled on the toner recovering bias current given by the power supply circuit 19. That is, the magnetic brush 14 is supplied with a new amount of toner commensurate with the amount of toner that is consumed by the development of an image. The amount of consumed toner and the amount of supplied toner are thus well balanced, and hence any excessive or insufficient toner supply is avoided.

Figure 26:
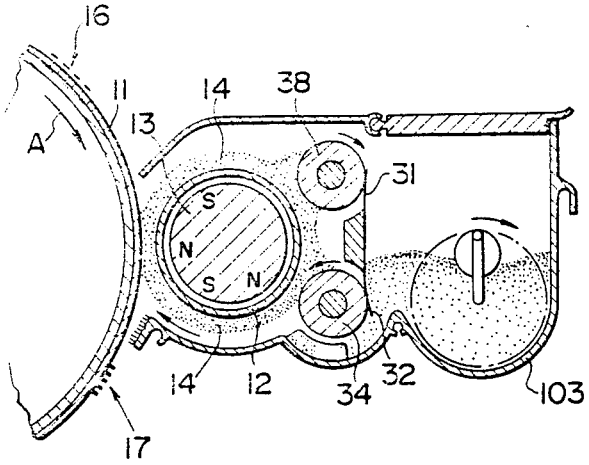
Figure 27:
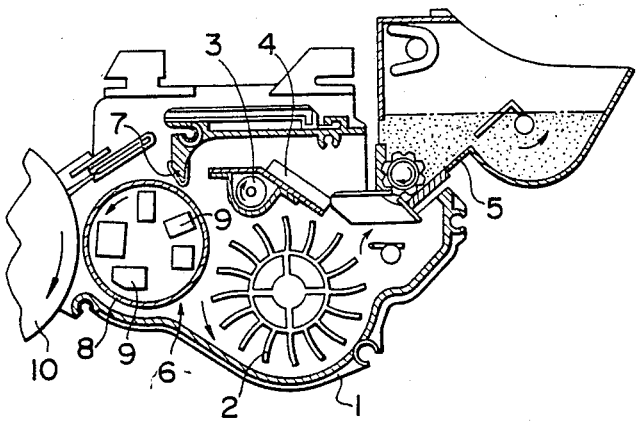
FIG. 27 (PRIOR ART)
FIG. 27 is a vertical cross-sectional view of a conventional image developing apparatus.

In a still further embodiment shown in FIG. 26, a permanent magnet 13 has areas in which no magnetic poles are present in opposite relation to a toner recovery roller 38 and a toner supply roller 34. Therefore, no magnetic brush is formed over such areas. Since there is no magnetic pole in the area close to the toner recovery roller 38, carrier particles move highly at random in such area for thereby allowing toner to be in good contact with the toner recovery roller 38, enabling the toner recovery roller 38 to recover toner with increased efficiency. The permanent magnet 13 has a magnetic pole positioned immediately downstream of the toner supply roller 34 in the direction of travel of the magnetic brush 14. This magnetic pole serves to supply toner to the carrier which has passed through the gap between the sleeve 12 and the toner supply roller 34, whereupon the magnetic brush 14 is quickly formed. The carrier is prevented from being recovered by the toner recovery roller 38 because the carrier is charged to the polarity opposite to that of the toner and a bias voltage of the same polarity as that of the carrier is applied to the toner recovery roller 38.

The gap between the peripheral surface of the toner recovery roller 38 and the peripheral surface of the sleeve 12, and the gap between the peripheral surface of the toner supply roller 34 and the peripheral surface of the sleeve 12 are smaller than the gap (image developing gap) between the photosensitive drum 11 and the sleeve 12 for effectively supplying and recovering toner. It is however possible to equalize the above former two gaps to the image developing gap.

In each of the above embodiments, the sleeve is shown as cylindrical. However, a belt-like sleeve may also be employed.

Figure 28:
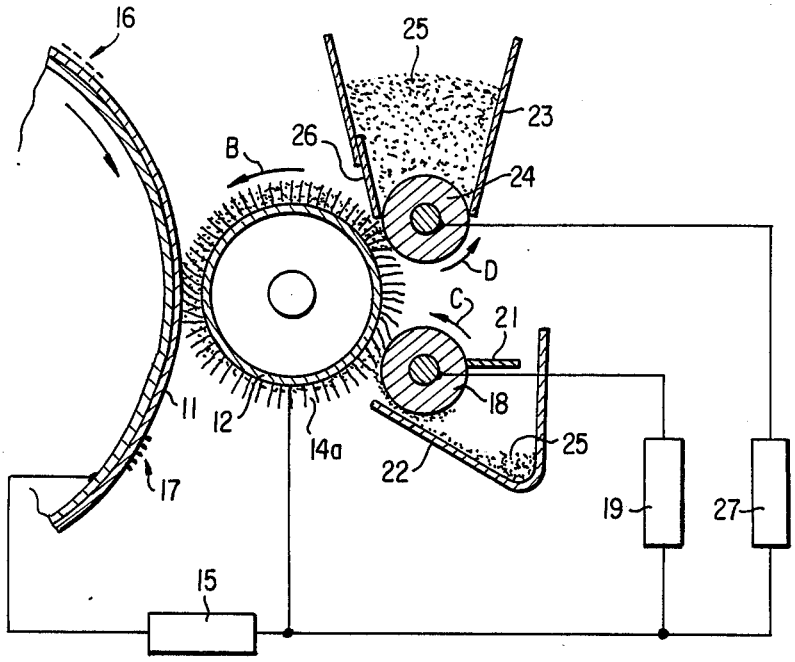
FIG. 28 corresponds to FIG. 1, except that it shows a fiber brush.

In each of the embodiments except those shown in FIGS. 14, 17, 18, 19, 20, and 26, the magnetic brush may be replaced with a fiber brush,, and toner can be supplied to, delivered by, applied for image development by, and recovered from such a fiber brush in the same manner as described above. The fiber brush may for example be composed of a roller with its peripheral surface electrostatically flocked with fibers 14*a* each in the form of a nylon yarn, about 1 mm long and about 20 micrometers thick, at a density of about 30 thousand yarns/square inches. For example, FIG. 28 corresponds to FIG. 1, except that it shows the fiber brush having fibers 14*a*.

Although certain preferred embodiments have been shown and described, it should be understood that many changes and modifications may be made therein without departing from the scope of the appended claims.

We claim:

1. A method of developing an electrostatic latent image, comprising the steps of:

preliminary charging a toner;

supplying the preliminary charged toner to resilient developing brush means held in resilient contact with a latent image carrier while electrically charging the toner in a toner supplying region;

transferring the preliminary charged toner on said resilient developing brush means to an image developing region;

developing an electrostatic latent image formed on said image carrier with the toner by bringing said resilient developing brush means into contact with said latent image carrier in said image developing region;

transferring said resilient developing brush means from said image developing region to a toner recovering region separate from said toner supplying region after the image has been developed;

recovering residual toner from said resilient developing brush means in said toner recovering region in order to remove toner density irregularities from said resilient developing brush means; and thereafter, transferring said resilient developing brush means again to said toner supplying region for successive image development.

2. A method according to claim 1, wherein said resilient developing brush means comprises a magnetic brush disposed on a sleeve and having brush fibers formed by a magnetic field.

3. A method according to claim 1, wherein said resilient developing brush means comprises a fiber brush composed of fibers on a roller.

4. The method of claim 2, wherein said magnetic brush means has a toner supplying capability in said developing step and wherein said recovery step comprises recovering residual toner from said magnetic brush means at a rate exceeding said toner supplying capability, whereby toner density on said magnetic brush means can be uniformized.

5. An apparatus for developing an electrostatic latent image, comprising:

means for preliminary charging a toner;

means for supplying the preliminary charged toner to resilient developing brush means held in resilient contact with a latent image carrier while electrically charging the toner in a toner supplying region;

means for transferring the preliminary charged toner on said resilient developing brush means to an image developing region;

means for developing an electrostatic latent image formed on said image carrier with the toner by bringing said resilient developing brush means into contact with said latent image carrier in said image developing region;

means for transferring said resilient developing brush means from said image developing region to a toner recovering region separate from said toner supplying region after the image has been developed;

means for recovering residual toner from said . resilient developing brush means in said toner recovering region in order to remove toner density irregularities from said resilient developing brush means; and means for again transferring said resilient developing brush means to said toner supplying region for successive image development.

6. An apparatus according to claim 5, wherein said resilient developing brush means comprises a magnetic brush disposed on a sleeve and having brush fibers formed by a magnetic field, said toner supply means including a toner supply power supply circuit for applying a bias voltage to supply the toner to the magnetic brush, said means for recovering residual toner including a toner recovery power supply circuit for applying a bias voltage to recover the residual toner from the magnetic brush, further including a control device coupled to said toner supply power supply circuit for calculating a proper amount of toner to be supplied based on a detected signal indicative of an amount of toner consumed for developing the image, and for varying the bias voltage from said toner supply power supply circuit according to the amount of toner consumed.

7. The apparatus of claim 6, wherein said means for recovering residual toner from said brush means comprises means for recovering toner at a rate exceeding a toner supplying capability of said brush means, whereby toner density on said brush means can be uniformized.

8. An apparatus according to claim 5, wherein said resilient developing brush means comprises a magnetic brush disposed on a sleeve and having brush fibers formed by a magnetic field, said means for supplying toner including a tone layer limiting member for triboelectrically charging the supplied toner while shaping the supplied toner into a uniform thin layer, said toner layer limiting member comprising a magnetic field generating body and carrier particles held on magnetic lines of forced produced by said magnetic field generating body.

9. An apparatus according to claim 5, wherein said resilient developing brush means comprises a magnetic brush disposed on a sleeve and having brush fibers formed by a magnetic field, said means for supplying toner including a toner scraper member for scraping off the residual toner toward said means for supplying toner after the toner has been supplied to said magnetic brush.

10. An apparatus according to claim 5, wherein said resilient developing brush means comprises a magnetic brush disposed on a sleeve and having brush fibers formed by a magnetic field, at least one of said toner supply means and said means for recovering residual toner including a magnetic body for collecting a magnetic carrier.

11. An apparatus according to claim 5, wherein said resilient developing brush means comprises a magnetic brush disposed on a sleeve and having brush fibers formed by a magnetic field, at least one of said means for supplying toner and said means for recovering toner including means for switching around upper and lower layers of said magnetic brush.

12. An apparatus according to claim 5, wherein said resilient developing brush means comprises a magnetic brush disposed on a sleeve and having brush fibers formed by a magnetic field, said magnetic brush having magnetic poles disposed upstream of centers, respectively, of said image developing regions, said toner supplying regions, and said toner recovering region, as measured in a direction of travel of said magnetic brush.

13. An apparatus according to claim 5, wherein said resilient developing brush means comprises a magnetic brush disposed on a sleeve and having brush fibers formed by a magnetic field, said sleeve and said means for supplying toner being spaced from each other by a first gap, said sleeve and said latent image carrier being spaced from each other by a second gap, said sleeve and said means for recovering toner being spaced from each other by a third gap, said first gap being equal to or smaller than said second and third gaps.

14. An apparatus according to claim 5, wherein said resilient developing brush means comprises a magnetic brush disposed on a sleeve and having brush fibers formed by a magnetic field, further including means for applying a bias voltage of a polarity opposite to that of the toner to said means for supplying toner, and means for supplying a bias voltage of the same polarity as that of the toner to said means for recovering toner.

15. An apparatus according to claim 5, wherein said resilient developing brush means comprises a magnetic brush disposed on a sleeve and having brush fibers formed by a magnetic field, said means for supplying toner including a toner supply power supply circuit for applying a bias voltage to supply the toner to the magnetic brush, said means for recovering toner including a toner recovery power supply circuit for applying a bias voltage to recover the residual toner from the magnetic brush, further including a control device coupled to said toner supply power circuit for calculating a proper amount of toner to be supplied based on a detected signal indicative of an amount of toner recovered, and for varying the bias voltage from said toner supply power supply circuit according to the amount of toner recovered.

16. An apparatus according to claim 5, wherein said resilient developing brush means comprises a fiber brush composed of fibers on a roller, said means for supplying toner including a toner supply power supply circuit for applying a bias voltage to supply the toner to the fiber brush, said means for recovering toner including a toner recovery power supply circuit for applying a bias voltage to recover the residual toner from the fiber brush, further including a control device coupled to said toner supply power supply circuit for calculating a proper amount of toner to be supplied based on a detected signal indicative of an amount of toner consumed for developing the image, and for varying the bias voltage from said toner supply power supply circuit according to the amount of toner consumed.

17. An apparatus according to claim 5, wherein said resilient developing brush means comprises a fiber brush composed of fibers on a roller, said means for supplying toner including a toner layer limiting member for triboelectrically charging the supplied toner while shaping the supplied toner into a uniform thin layer, said toner layer limiting member comprising a magnetic field generating body and carrier particles held on magnetic lines of force produced by said magnetic field generating body.

18. An apparatus according to claim 5, wherein said resilient developing brush means comprises a fiber brush composed of fibers on a roller, said means for supplying toner including a toner scraper member for scraping off the residual toner toward said means for supplying toner after the toner has been supplied to said fiber brush.

19. An apparatus according to claim 5, wherein said resilient developing brush means comprises a fiber brush composed of fibers on a roller, said roller and said means for supplying toner being spaced from each other by a first gap, said roller and said latent image carrier being spaced from each other by a second gap, said roller and said means for recovering toner being spaced from each other by a third gap, said first gap being equal to or smaller than said second and third gaps.

20. An apparatus according to claim 5, wherein said resilient developing brush means comprises a fiber brush composed of fibers on a roller, further including means for supplying a bias voltage of a polarity opposite that of the latent image to said means for supplying toner, and means for applying a bias voltage of the same polarity as that of the latent image to said means for recovering toner.

21. An apparatus according to claim 5, wherein said resilient developing brush means comprises a fiber brush composed of fibers on a roller, said means for supplying toner including a toner supply power supply circuit for applying a bias voltage to supply the toner to the fiber brush, said means for recovering toner including a recovery power supply circuit for applying a bias voltage to recover the residual toner from the fiber brush, further including a control device coupled to said toner supply power supply circuit for calculating a proper amount of toner to be supplied biased on a detected signal indicative of an amount of toner recovered, and for varying the bias voltage from said toner supply power supply circuit according to the amount of toner recovered.

* * * * *

UNITED STATES PATENT AND TRADEMARK OFFICE

CERTIFICATE OF CORRECTION

PATENT NO. : 4,885,223

DATED : Dec. 5, 1989

INVENTOR(S) : Shigekazu Enoki, et al

It is certified that error appears in the above-identified patent and that said Letters Patent is hereby corrected as shown below:

On the title page:

The total number of Drawing Sheets is incorrect, should be: --15--

Signed and Sealed this

Twenty-eighth Day of May, 1991

*Attest:*

HARRY F. MANBECK, JR.

*Attesting Officer*

*Commissioner of Patents and Trademarks*